US005775518A

United States Patent [19]

Connor

[11] Patent Number: 5,775,518

[45] Date of Patent: Jul. 7, 1998

[54] KITCHEN CADDY

[76] Inventor: Jamie C. Connor, c/o Source Manufacturing Co. Inc. 191 Post Rd. West, Weston, Conn. 06880

[21] Appl. No.: 654,574

[22] Filed: May 29, 1996

[51] Int. Cl.[6] ..... A47F 7/00

[52] U.S. Cl. ..... 211/70.7; 211/70; 211/163; 248/37.3; D7/637

[58] Field of Search ..... 211/70.7, 70, 163; 248/37.3; D7/637

[56] References Cited

U.S. PATENT DOCUMENTS

| | | | |
|---|---|---|---|
| D. 271,171 | 11/1983 | Kinkade | D7/74 |
| D. 329,766 | 9/1992 | Ancona et al. | D6/467 |
| D. 334,265 | 3/1993 | Guigiaro | D32/55 |
| 2,446,016 | 7/1948 | Lessin | 211/70.6 X |
| 2,550,621 | 4/1951 | Tau | 211/60.1 X |
| 3,848,943 | 11/1974 | Geesaman et al. | 312/284 |
| 4,305,511 | 12/1981 | Denholtz | 211/70 |
| 4,318,478 | 3/1982 | De Winter | 211/60.1 X |
| 4,412,618 | 11/1983 | La Conte | 206/581 |
| 4,423,552 | 1/1984 | Bourgein et al. | 30/296 A |
| 4,509,651 | 4/1985 | Prindle | D7/637 |
| 4,534,474 | 8/1985 | Ng | 211/70 |
| 4,909,400 | 3/1990 | Dubinsky | 211/70 |
| 4,936,470 | 6/1990 | Prindle | 211/70.7 |
| 4,953,696 | 9/1990 | Huang et al. | 211/70 X |
| 5,361,915 | 11/1994 | Cohen et al. | 211/70.7 |
| 5,377,850 | 1/1995 | Liaw | 211/163 |
| 5,379,885 | 1/1995 | Chen | 211/163 X |

FOREIGN PATENT DOCUMENTS 2058548 4/1981 United Kingdom .

*Primary Examiner*—Robert W. Gibson, Jr.
*Assistant Examiner*—Stephen S. Wentsler
*Attorney, Agent, or Firm*—Fattibene and Fattibene; Arthur T. Fattibene; Paul A. Fattibene

[57] ABSTRACT

This invention is directed to a kitchen caddy for compactly storing various kitchen aids such as knives, cooking implements such as serving spoons, spatulas, strainers, ladles and the like, and including a cutting board. The caddy includes a relatively simple housing construction having a minimum of component parts rotatably supported on a carousel. The housing is formed with a flat top surface provided with a central well for stowing the various cooking implements, and varying sized slots for receiving the various types of kitchen knives as well as a slot for stowing a cutting board, all compactly arranged requiring a minimum of counter space and providing for maximum ease of use.

4 Claims, 3 Drawing Sheets

KITCHEN CADDY

FIELD OF INVENTION

This invention is directed to a kitchen caddy, and more specifically to a kitchen caddy which is rotatably journalled on a carousel.

BACKGROUND OF THE INVENTION

Various types of kitchen storage units for storing various types of kitchen utensils are known. Some of the known types of kitchen storage units are disclosed in a number of issued patents such as the silverware type of holder disclosed in U.S. Pat. No. 3,848,943. A tray for grooming instruments is disclosed in U.S. Pat. No. 4,412,618. Knife blocks such as disclosed in U.S. Pat. No. 4,423,552 are also a well known type of kitchen aid. A collapsible kitchen utility holder is disclosed in U.S. Pat. No. 4,534,474. A United Kingdom Patent 2,058,548 discloses a tier type utility storage device. U.S. Pat. No. 5,361,915 discloses a relatively complex rotatable storage holder for various types of kitchen utensils and gadgets.

A number of design patents, such as U.S. Design Pat. Nos. 271,171; 329,766 and 334,265 are directed to the design of a block or housing in which various kitchen tools may be stowed.

SUMMARY OF THE INVENTION

An object of this invention is to provide a relatively simple compact storage unit for stowing various types of kitchen cooking utensils, e.g. knives, spoons, ladles, spatulas, strainers, etc., and a cutting board in a convenient, readily accessible housing.

Another object is to provide a relatively simple housing for stowing various cooking tools and a cutting board and which is rotatably supported on a carousel.

The foregoing objects and other features and advantages are attained by a housing having a flat top surface circumscribed by depending elongated sidewalls which terminate in a lower edge to which the base or bottom wall member is connected. The housing thus defined is rotatably supported on a carousel. The flat top surface is provided with a central well having a well bottom which engages a support or spacer projecting upwardly from the base member. Spaced about the well opening in the top surface of the housing are a series of slots which vary in length to form seats for the various types of kitchen knives. To one side of the well there is formed a transversely extending slot for receiving and stowing a cutting board.

The carousel is a disk having depending circumscribing skirt which terminates in a laterally outwardly extending flange and having circumferentially spaced on the disk a series of bearings upon which the housing is mounted for rotation relative to the carousel disk. The central well provides for the storage of such kitchen tools as a serving spoon, serving fork, strainer, ladles, scrapers and the like. The knives are seated in the appropriate knife slots, and the cutting board in the cutting board slot. The entire assembly provides a neat, compact storage unit in which the various kitchen tools are rendered readily accessible and occupy a minimum of counter space.

IN THE DRAWINGS

DETAILED DESCRIPTION

Figure 1:
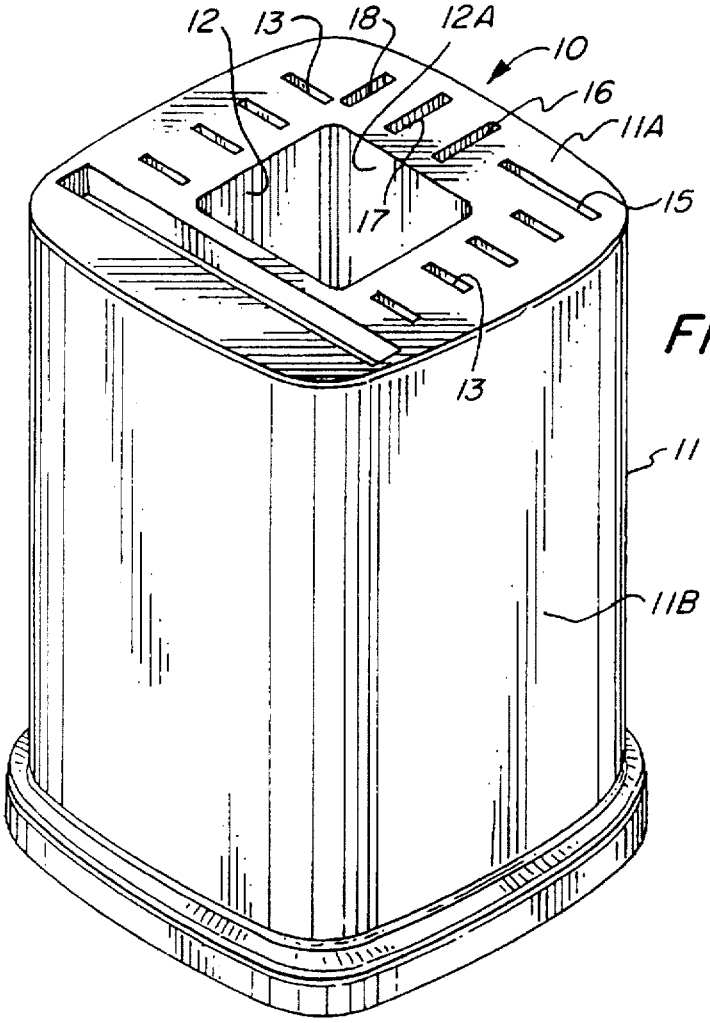
FIG. 1 is a perspective view of the kitchen caddy embodying the present invention without the kitchen tools.
Figure 3:
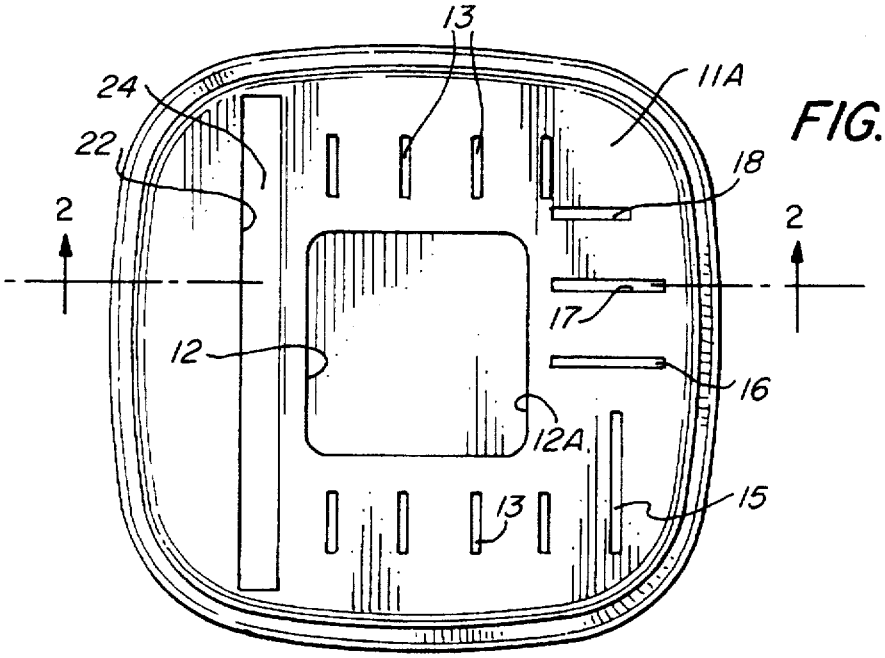
FIG. 3 is a top plan view of FIG. 1 without the kitchen tools.
Figure 2:
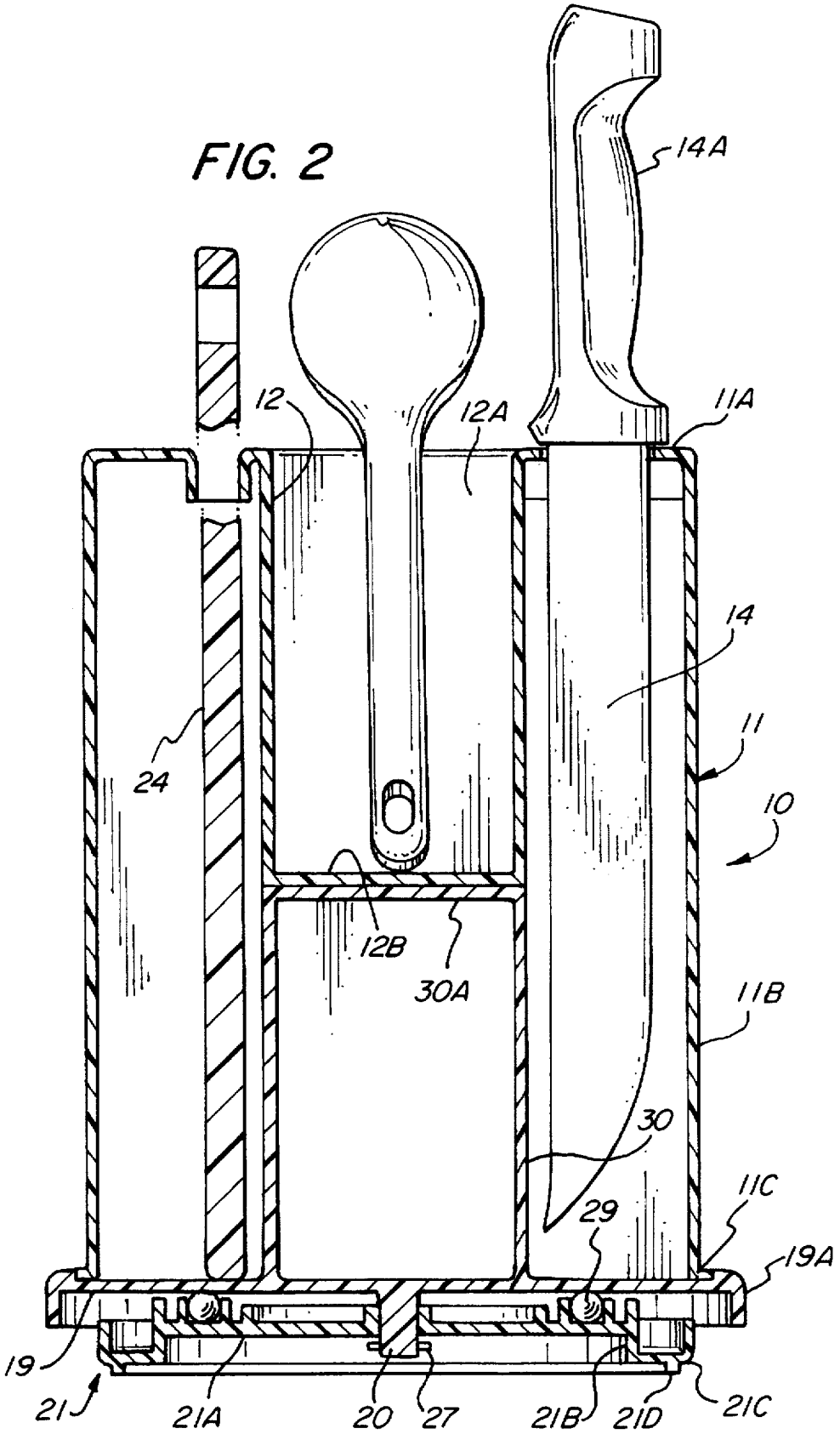
FIG. 2 is a sectional view taken along line 2—2 on FIG. 3.
Figure 4:
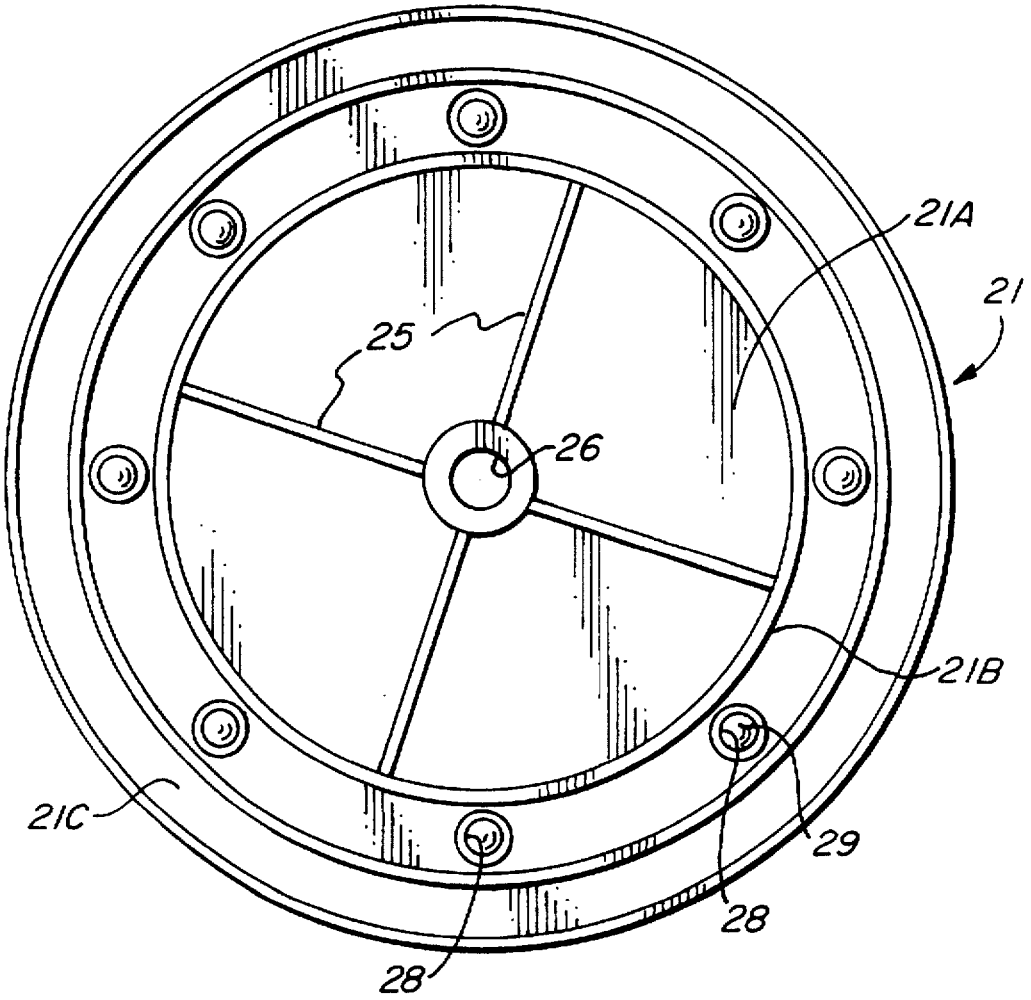
FIG. 4 is a plan view of the carousel.

Referring to the drawings, there is shown in FIG. 1 a perspective view illustrating a kitchen caddy 10 embodying the present invention. The kitchen caddy includes a housing 11 having a flat, generally rectangular top surface 11A with connected depending circumscribing sidewalls 11B which terminate in a lower or marginal edge 11C. As best seen in FIGS. 2 and 3, the top surface 11A is provided with a central well 12 having its opening 12A located in the plane of the top surface 11A. The well 12 is closed at its inner end by a bottom wall 12B. Essentially, the walls of the well 12 are generally vertical, and form the seat for receiving and stowing a number of various types of kitchen tools, e.g. serving or mixing spoons, ladles, strainers, serving forks, spatulas and the like.

Formed in the top surface 11A about the well opening 12A are a plurality of slots. In the illustrated embodiment, slots 13 disposed in a row on opposite sides of the well opening 12A are of uniform length and width which are sized to receive and stow a set of steak-type knives, not shown. The blades 14 of the steak knives extend into the hollow housing 11 with only the handle portions 14A projecting above the top surface 11A.

As shown in FIG. 3, a plurality of variable sized slots 15, 16, 17, 18 are formed in the top surface 11A to provide a seat for variable types of other knives commonly used in the kitchen, e.g. a bread knife, carving knife, paring knife, chopping knife and the like. The size of opening or slots 15 to 18 vary to accommodate the various blade widths of the knife adapted to be stowed therein. The arrangement is such that all the knife blades project downward within the housing. It will be understood that the height of the housing is proportioned to accommodate the knife having the longest blade.

Also formed in the top surface 11A is a transversely extending slot 22 which transverses a major portion of the width of the top surface 11A to form a seat for a cutting board 24.

A base member 19, having a shape corresponding to that of the housing 11, is secured to the lower or marginal edge 11C of the housing 11 in any suitable manner. In the illustrated embodiment, the bottom or base member 19 is provided with a depending circumscribing skirt 19A.

Formed on or connected to the bottom or base member is an outwardly projecting stud 20 which is located at the center of the base member for rotatably journalling the housing 11 on a carousel 21.

In the illustrated embodiment, the carousel 21 comprises a disk shaped member 21A which is sized so as to be received within the depending skirt 19A of the bottom member. Connected to the outer periphery of the disk member 21A is a circumscribing depending wall 21B that terminates in an outwardly and radially extending flange 21C. Connected or formed on the underside of the flange 21C is a circumscribing projecting rib 21D upon which the carousel rests on a supporting surface, such as a counter top or table. If desired, the disk member 21A may be provided with suitable reinforcing ribs 25. Located at the center of the disk member 21A is an opening or hole 26 for receiving the stud 20 projecting from the base member. A suitable retaining ring 27 secures the housing 11 to the carousel 21.

To minimize friction between the housing 11 and the carousel 21, there are circumferentially spaced about the periphery of the disk member 21A a plurality of bearing cups or holders 28. Disposed in each bearing cup or holder 28 is a ball bearing 29. It will be understood that the ball bearing 29 is rotatably retained within its bearing cup or holder 28.

In the assembled position as shown in FIG. 2, the base member 19 of the housing is resting on the ball bearings 29 so that the housing 11 can be readily rotated relative to the supporting carousel 21.

Projecting upwardly from the base member 19 is a spacer 30. As best seen in FIG. 2, the spacer 30 comprises a hollow structure or projection having its upper surface 30A disposed contiguous to or in contact with the bottom 12 B of the well 12.

With the construction described, it will be apparent that a relatively simple kitchen caddy is achieved consisting of a housing having only two component parts, viz. the housing 11 and the base member 19, both of which may be formed of molded plastic parts. The carousel 21 is also formed as an integral member with independent ball bearings 29 retained in the bearing cups 28. The spacer 30 engaging the bottom of the well 12 provides a stable central support for the entire housing and base assembly.

All of the variable knives have their respective blades sheathed within the housing. The miscellaneous cooking utensils are stowed in the well for ready access. Also unusual to known kitchen caddies is the slot 22 for stowing a cutting board so that it too is readily accessible. The entire kitchen caddy is sturdy and compact, easy to manufacture and assemble, and comprises a minimum of component parts.

While the present invention has been described with respect to a particular embodiment, variations and modifications may be made without departing from the spirit or scope of this invention.

What is claimed is:

1. A kitchen caddy comprising:

a generally rectangular unitary housing having a solid flat top surface and integrally connected circumscribing depending sidewalls terminating in a lower edge, a generally rectangular base member directly connected to said lower edge of said depending side walls of said unitary housing, said base member defining the bottom of said housing, said solid flat top surface having a depending well formed thereon adapted for receiving a plurality of cooking utensils such as ladles, spatulas, strainers and serving spoons, said well having a well bottom disposed in spaced relationship and intermediately between said flat top surface and said base member, a plurality of slots formed in said flat top surface disposed about said well, each of said slots being formed for receiving and holding only one of a given blade of a variety of knives therein, and an elongated slot formed in said flat top surface extending substantially transversely of the width of said flat top surface to one side of said well for stowing a cutting board therein, a spacer support projecting upwardly from said base and in alignment with said well, and said spacer support having an upper surface engaging said well bottom to provide a stable central support for said housing and connected base assembly, and a carousel connected to said base member for rotatably supporting said housing thereon.

2. A kitchen caddy as defined in claim 1 wherein said carousel includes a unitary molded disk having a circumscribing depending wall, said wall terminating in a laterally outwardly extending flange, and an external circumscribing rib formed on the bottom of said flange adapted to support said housing and connected carousel on a supporting surface, plurality of bearing cups circumferentially spaced about the surface of said disk, a ball bearing supported in each of said bearing cups, and said base member of said housing being disposed in bearing relationship on said ball bearings.

3. A kitchen caddy for storing a plurality of kitchen knives and cooking implements comprising:

a generally rectangular housing having a solid flat top surface and having integrally connected circumscribing depending sidewalls terminating in a lower marginal edge, a base member connected to said lower marginal edge of said sidewalls, said solid, flat top surface having a central well formed therein so as to depend from said solid flat top surface to project into said housing, said well having a well bottom disposed intermediate the height of said housing, a plurality of cooking implements arranged to be maintained in said well, a plurality of knife slots formed in said solid flat top surface, said knife slots being of varying lengths, each of said slots being sized to accommodate only the blade portion of a given knife, a knife blade seated in each of said slots, a transversely extending slot disposed to one side of said well, said transverse slot extending along substantially the entire width of said housing, a cutting board arranged to be seated in said transverse slot, a spacer connected to said base member, said spacer projecting upwardly from said base member so as to be disposed in alignment with said well bottom, and said spacer having an upper surface disposed in engagement with said well bottom to define a central support for said housing, and a carousel connected to said base member for rotatably supporting said housing thereon.

4. A kitchen caddy as defined in claim 3 wherein said base member having an outwardly projecting stud, and said carousel includes:

a unitary molded disk having a circumscribing depending wall, said disk having a central opening formed therein for rotatably receiving said stud, said wall terminating in a laterally outwardly extending flange, including a plurality of bearing cups circumferentially spaced about said molded disk, a ball bearing disposed in each of said bearing cups whereby said base member of said housing is rotatably supported on said ball bearings, and an external circumscribing rib formed on said flange adapted to support said housing and connected carousel on a supporting surface.

* * * * *